United States Patent [19]

Gilbert et al.

[11] 3,962,048

[45] June 8, 1976

[54] METHOD FOR FORMING A UNIFORM OXIDE FILM ON A VALVE METAL

[75] Inventors: Curtiss M. Gilbert; Richard A. Bemis; Norman D. Schulze, all of North Adams, Mass.

[73] Assignee: Sprague Electric Company, North Adams, Mass.

[22] Filed: Jan. 8, 1975

[21] Appl. No.: 539,360

Related U.S. Application Data

[63] Continuation-in-part of Ser. No. 434,716, Jan. 18, 1974, abandoned.

[52] U.S. Cl. ..... 204/28; 204/211; 204/274; 204/275

[51] Int. Cl.[2] ..... C25D 7/06; C25D 11/02; C25D 17/00; C25D 21/02

[58] Field of Search ..... 204/13, 28, 211

[56] References Cited

UNITED STATES PATENTS

| | | | |
|---|---|---|---|
| 1,965,399 | 7/1934 | Wehe | 204/211 X |
| 3,061,534 | 10/1962 | Jasperson | 204/211 |
| 3,536,601 | 10/1970 | Hill et al. | 204/147 |

*Primary Examiner*—John H. Mack
*Assistant Examiner*—Aaron Weisstuch
*Attorney, Agent, or Firm*—Connolly and Hutz

[57] ABSTRACT

In a continuous electrolytic foil forming process employing a source of constant d.c. voltage, the speed with which the foil is drawn through the electrolyte is automatically adjusted by a feedback mechanism to maintain a constant value of forming current, thereby producing an oxide film whose thickness is substantially invariant over the entire length of the foil.

13 Claims, 5 Drawing Figures

METHOD FOR FORMING A UNIFORM OXIDE FILM ON A VALVE METAL

CROSS REFERENCE TO RELATED APPLICATION

The present application is a continuation-in-part of our copending application Ser. No. 434,716, filed Jan. 18, 1974, abandonded.

BACKGROUND OF THE INVENTION

The present invention relates to the formation of an oxide film on the surface of a valve-metal and more particularly to a continuous process of formation of an oxide film by electrolytic means on an etched valve-metal foil. Such formed foil is typically used in the manufacture of electrolytic capacitors. The word "forming" and variations thereof are used herein to mean anodizing, as is common practice in the art.

Formed foil is conventionally made by drawing a bare metal foil strip through a liquid electrolyte solution and applying a d.c. voltage between the foil and a negative electrode that is also submersed in the electrolyte solution. The foil to be formed has normally been etched so as to increase the effective surface area. The ratio of the area after etching to the original plane area is called the etch ratio.

Etched foil that is typically provided for such purposes does not have a uniform etch ratio. This lack of etch ratio uniformity causes the formation current to vary in a continuous formation process. The variations in formation current result in changes in the voltage drops in the electrolyte and the associated circuitry. The ultimate result is undesirable variations in the oxide film thickness. Furthermore, the d.c. power supply employed in the continuous formation process cannot be operated at its maximum current rating since current variations must be allowed for in establishing the normal or average current drawn from it. This means that for a given formation facility, operation at maximum loading is never possible. Since the d.c. power source, for example a d.c. generator, represents a major portion of the investment in a formation facility, this is an important consideration, adversely impacting the cost of manufacturing formed foil.

It is therefore an object of the present invention to provide a continuous method for forming a uniformly thick oxide film on a valve-metal foil.

It is a further object of the present invention to provide an economic continuous method for forming an oxide film on a valve-metal foil.

It is yet a further object of the present invention to provide a continuous method for forming an oxide film on a valve metal wherein the d.c. power source may be operated continuously at its maximum rated output.

SUMMARY OF THE INVENTION

A continuous method for forming an oxide film on a valve-metal foil comprises continuously drawing a foil through an electrolyte, applying a constant d.c. voltage between the electrolyte and the foil, sensing the forming current, and varying the drawing speed inversely with the forming current so as to maintain the forming current essentially constant at a predetermined desired value. As a result, variations in foil etch ratio will be so compensated, so that the oxide thickness will remain substantially constant over the entire length of the processed foil. Further, the d.c. voltage source may be operated continuously at its maximum output capability since the current and voltage are constant.

BRIEF DESCRIPTIONS OF THE DRAWINGS

The five figures have been drawn so that the distances $x$ along the submersed foil between O and X are aligned for all figures.

DESCRIPTION OF THE PREFERRED EMBODIMENTS

Figure 1:
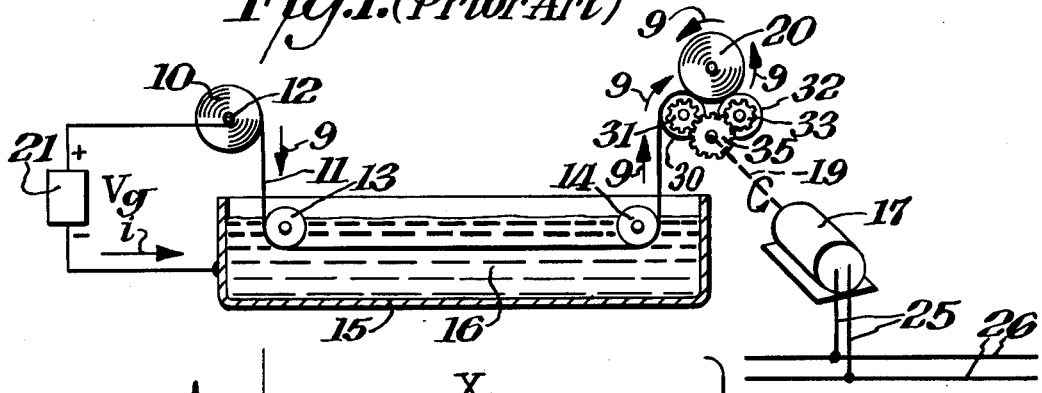
Fig.1. (Prior Art)
FIG. 1 shows a schematic of a prior art apparatus for carrying out a continuous foil forming process.

In FIG. 1 is shown a schematic of a prior art apparatus for carrying out a foil forming process. A supply roll 10 of etched aluminum, tantalum or other valve metal foil 11 is supported by a spindle 12. The outer end of foil 11 is threaded under a first and a second idler roller, 13 and 14, respectively, such that between these idler rollers the foil 11 is horizontal. In other prior art processes the foil is vertical.

An open topped metal tray or tank 15 contains a liquid electrolyte 16 into which idler rollers 13 and 14 are at least partially submerged and thus submersing foil 11 in the region therebetween.

The foil 11 is further threaded over driven spindles 30 and 32 of equal diameter and is finally wound into a roll 20 of formed foil. The roll 20 is supported and turned so as to continuously collect the formed foil by the two driven spindles 30 and 32. The route of the threaded foil 11 is shown by arrows 9. Fixed to each of spindles 30 and 32 are identical gears 31 and 33, respectively, that are driven by meshing gear 35, which in turn is driven by drive coupling 19 represented by a dotted line. The coupling 19 is driven by a constant speed motor 17. The coupling 19 represents any of several well known coupling means that assures correspondence between the motor speed and the rate of rotation of spindles 30 and 32. This coupling typically comprises a gear reduction box, but it may be simply a shaft. In any case, the foil is drawn at a speed that is proportioned to the motor speed, without regard to the diameter of the collecting roll 20. The motor is shown as a synchronous a.c. motor being connected to an a.c. power line 26 by wires 25.

in d.c. power supply 21 provides a constant voltage, Vg, between the foil 11 at spindle 12 and the electrolyte 16 at the tank 15. The tank 15 is this case acts as the negative electrode. The series circuit thus created has a current $i(t)$ flowing therein. As long as the voltage, Vg, the resistivity of the electrolyte, the speed with which the foil is drawn through the electrolyte, and the foil etch ratio remain constant, the current $i(t)$ also remains constant.

However, it will be recognized by those skilled in the art that a substantial voltage drop occurs in the electrolyte itself and elsewhere such that when foil etch ratio increases, an increase in current will cause an increased voltage drop in the electrolyte and in the tank electrode and in the foil itself. Therefore, the varying current causes the voltage appearing across the oxide to vary. Consequently the oxide thickness and the voltage withstanding capability of the oxide coated film is not uniform. The degree of uniformity of this voltage withstanding capability is a key measure of the quality of such formed film for use in the manufacture of electrolytic capacitors.

Furthermore, if the normal current associated with normal etch ratio is the maximum of which the power source is capable, then the current cannot be increased at all in response to an increase in foil etch ratio. The alternative is to operate at a normal or average current that is significantly less than the maximum of which the power source is capable, to allow for expected variations in the current. Traditionally this is what is actually done.

Figure 2:
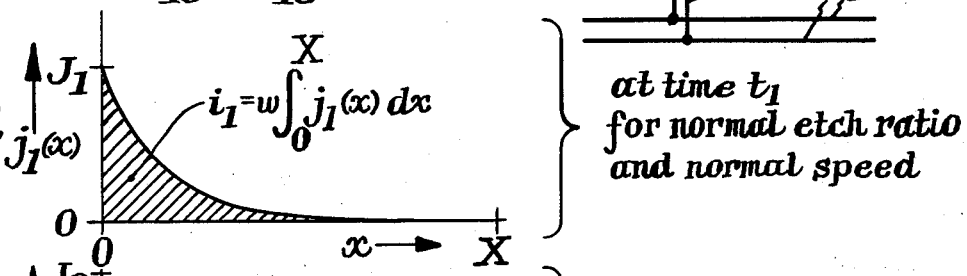
FIG. 2 shows a curve representing the forming current density in the apparatus of FIG. 1, as a function of a distance $x$ along the submersed foil, at a time $t_1$ when all the submersed foil has a normal etch ratio.

In FIG. 2 is shown a curve representing the forming current density $j_1(x)$ in the prior art apparatus of FIG. 1, as a function of distance $x$ along the submersed foil, at a time $t_1$ when all the submersed foil has a normal etch ratio. The current densities referred to herein are defined as the current entering a unit "plane" area of foil. Thus the current density $j$ at a point $x$ in the foil, times an incremental distance along the foil $dx$, times the width $w$ of the foil gives the current entering the corresponding region of the foil. Note that in this definition of current density, no account has yet been taken of etching. It can be shown that the current density as a function of time, and in this continuous process also distance, is essentially an exponential decay function as shown. The total current $i_1$ flowing in the circuit at time $t_1$ is $$i_1 = w \int_O^X j_1(x)dx,$$

which corresponds to the area under the curve in FIG. 2. The current density for the situation of FIG. 2 and at $x = 0$ is designated $J_1$.

Figure 3:
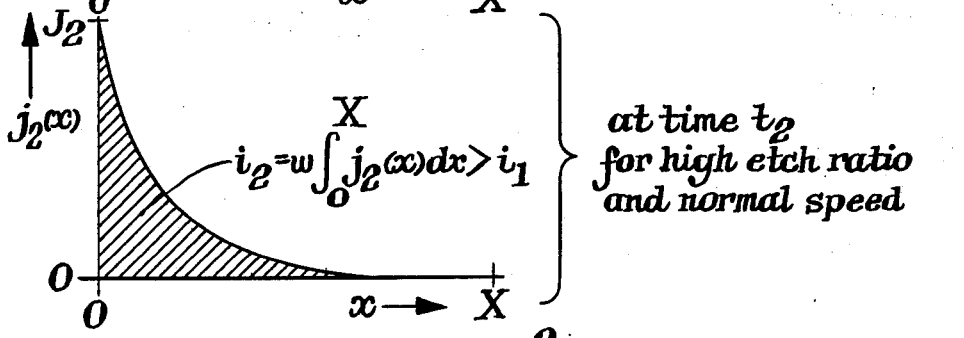
FIG. 3 shows a curve representing the forming current density in the apparatus of FIG. 1, as a function of a distance $x$ along the submersed foil, at a time $t_2$ when all the submersed foil has an above-normal etch ratio.

In FIG. 3 is shown a curve representing the forming current density $j_2(x)$ in the prior art apparatus of FIG. 1, as a function of distance $x$ along the submersed foil, at a time $t_2$ when all the submersed foil has an above normal etch ratio. The current density $J_2$ at $x = 0$ in FIG. 3 is shown to be greater than that of the foil being used in the situation of FIG. 2. The curve of FIG. 3 has the same decay rate as for $t_1$ but the area under the curve at $t_2$ is seen to be greater and therefore total current $i_2$ is greater than $i_1$.

$J_2$ is higher than $J_1$ by an amount approximately proportional to the difference between the high and normal foil etch ratios. This is predicated on the fact that in the case of the higher etch ratio, the area of contact between the foil and the electrolyte is proportionally greater and the resistance of the electrolyte is a region is inversely proportional to the etch ratio.

Thus it is shown that in a prior art apparatus having a constant foil speed, the initial current density $j$ varies as a function of foil etch ratio, and to at least a first approximation this function is a positive constant times the foil ratio. It follows that for a change in etch ratio, that a similar change in total current occurs and all other conditions remaining constant the current change would exactly compensate for the etch ratio change so that the resulting foil formation is uniform, only if there were no accompanying changes in the voltage drops of the foil, the tank and the electrolyte. In practice, however, these voltage drops are highly significant. For example a drop of 10 volts in the electrolyte as a result of normal changes in foil etch ratio is typical for a prior art machine running at a average forming current of 1000 amperes. The voltage drops in the foil itself may be even greater when forming very thin and/or narrow foil.

According to the principles of this invention, the source voltage is held constant, and the foil speed is varied so as to keep the total current at a predetermined constant value at all times. Thus for example, when in the continuous process of this invention the foil etch ratio increased, the foil drawing speed is reduced by an amount necessary to prevent an increase in total forming current and therefore to hold the total forming current constant.

Figure 4:
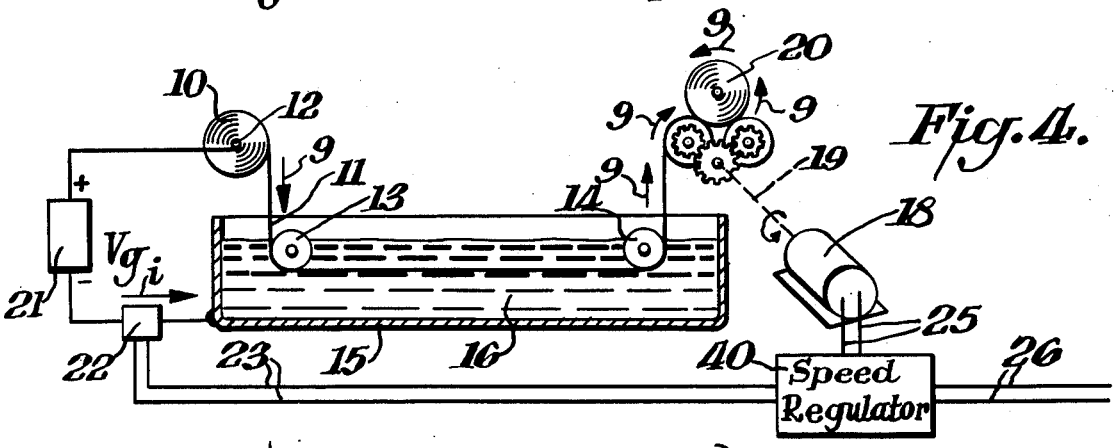
FIG. 4 shows a schematic of an apparatus for carrying out a continuous foil forming process according to the principles of this invention.

In FIG. 4 is shown in schematic form an apparatus for carrying out the process of the present invention. A supply roll 10 of etched foil 11 is supported by a spindle 12. The outer end of foil 11 is threaded under a first and second idler roller, 13 and 14, respectively, such that between these idler rollers the film 11 is horizontal. Of course, the foil may be drawn vertically or at any convenient angle as may be dictated by other factors of machine design.

In the preferred embodiment of this invention shown in FIG. 4 the mechanical arrangement for holding, submersing, and drawing the foil are all similar to the prior art apparatus of FIG. 1 and corresponding numbers have been used for corresponding elements.

The d.c. power supply 21 supplies a constant voltage between the foil 11 at spindle 12 and the electrolyte 16 at the tank 15. A low impedance current sensing device is connected in series with this circuit. The output of this sensing device 22 is connected by wires 23 to a motor speed regulator 40. The output voltage of the sensing device 22 is proportional to the forming current $i$. Thus the sensing device 22 may be a simple low value resistor.

The motor speed regulator 40 receives energy from an a.c. power line 26 and by connection via wires 25 to a variable speed motor 18, controls the speed of the motor 18. The speed regulator 40 causes the motor 18 to decrease speed when the signal from sensing device increases and vice versa. The regulator 40 is preprogramed to maintain the sensing device signal and thus the forming current at a predetermined value.

Figure 5:
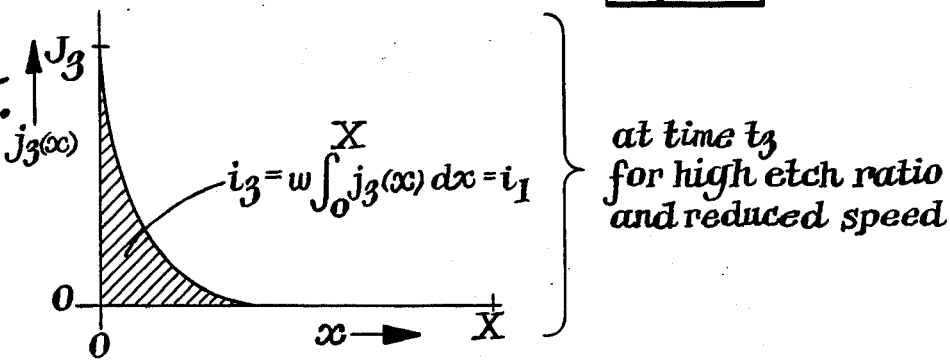
FIG. 5 shows a curve representing a forming current density in the apparatus of FIG. 4, at a time $t_3$ when all the submersed foil has an above-normal etch ratio.

In FIG. 5 is shown a curve representing the forming current density $j_3(x)$ in the apparatus of FIG. 4, as a function of distance $x$ along the submersed foil, at a time $t_3$ when all the submersed foil has an above normal etch ratio. The speed with which the foil is being drawn through the electrolyte has been decreased so that the total current $i_3$ is equal to the total current $i_1$, of FIG. 2 wherein foil is drawn at a constant nominal rate. The only difference between the conditions of operation associated with FIGS. 2 and 5 are foil etch ratios and foil speed. When in the apparatus of FIG. 4 the foil etch ratio has a normal value, the curve of FIG. 2 may represent the current density distribution in the system, since the foil speed will be that associated with FIG. 2 to provide a constant nominal value of total current.

It is seen that in the practice of this invention, the supply voltage is held fixed and the total forming current is continuously maintained at a constant value. The power supply can therefore advantageously be operated at its maximum output loading capability. In other words, the rate of production of formed foil can be as great as the particular power supply of the production facility will tolerate, as dictated by its maximum output loading rating. Since the power supply typically represents a major portion of the production facility cost, this beneficial feature of the instant invention is highly significant.

It is surprising, in a continuous process for forming film having a varying etch ratio, that one can maintain the total formation current constant by continuously adjusting the foil drawing speed. It is astonishing, however, that this results in the production of a uniformly thick oxide film. As is explained herein above in the description of the preferred embodiment of this invention, the fact that the current is maintained constant, insures that the voltage drops in each element of the series circuit are each maintained constant. The overall voltage drop in the electrolyte is maintained constant, and even though the voltage drops in each region of the electrolyte along the foil are not necessarily held constant, it is believed that the highest voltage appearing across the formed oxide occurs in the region where the foil is about to exit from the electrolyte. This highest voltage is maintained constant since the bulk drops in the foil and the electrolyte are constant. The result is the production of foil having a uniformly thick oxide film over its entire lenth. This theory is included with the intention of providing full and clear disclosure of the invention, however, applicants are not to be bound by their theory.

A prototype according to the preferred embodiment of this invention was built and tested. All portions of the apparatus, as schematically shown in FIG. 4, were made from a standard prior art apparatus with exception of the following special elements: The current sensing device 22 is a standard 2000 ampere-50 millivolt shunt. The motor 18 is a variable speed DC shunt wound motor, Model 5BCD56RA33, supplied by the Vee Arc Company of Westboro, Mass. The a.c. line 26 is a 220 volt single phase line. The speed regulator 40 is comprised of two basic parts, namely a d.c. Voltage Comparator model 640 made by Research, Inc. of Minneapolis, Minn., and an Adjustable Speed Motor Controller model 33-2 made by the Vee Arc Company. The comparator includes a manually adjustable d.c. voltage reference against which the sensing voltage that is developed across the shunt is compared. The difference voltage is amplified and applied to the control input of the Motor Controller. The Motor Controller contains a rectifier for changing the a.c. power from the line to d.c. for delivery to the motor. The nominal motor speed is adjustable within the controller. The desired current is pre-programed by adjusting the above mentioned reference voltage in the Comparator. A special circuit is provided in the regulator 40 for temporarily overriding the sensing voltage and initially bringing the motor up to the desired nominal speed, after which the machine operates in the automatic mode as previously described.

It has been observed that with a foil whose etch ratio varies 10% that the oxide thickness varies no more than 2% as determined by a standard "wet-check" test of the formed foil. It has also been observed that the remaining variations in oxide thickness are partly a result of variations in the temperature and concentration of the electrolyte. It can be seen from the description and theory of operation of the process of this invention, as presented herein, that it is important to maintain these two electrolyte variables as nearly constant as is practicable, since variation in these factors cause unwanted changes in the voltage drop across the electrolyte. Since in this continuous electrochemical forming process, heat is continuously being introduced into the electrolyte by the large currents flowing therein, temperature control of the electrolyte may be achieved by inserting pipes into the electrolyte and regulating the amount of cold water flowing therethrough in response to an electrolyte temperature sensing means. Further, the continuous electrochemical action constantly tends to reduce the concentration of the electrolyte which in turn changes its bulk resistivity. Thus, a means for maintaining the electrolyte concentration is necessary and preferably consists in automatically adding fresh electrolyte in a concentrated form. This has been achieved by known standard resistivity measurement techniques wherein the resistance measuring device provides an output signal proportional to the measured resistors. This signal is then used to control the stroke length of a chemical feed pump which pumps concentrated electrolyte to the forming bath. In the prototype apparatus the electrolyte is force pumped at a high rate, namely complete recirculation is realized about every five minutes, in order to help equalize and stabilize temperature and conentration of the electrolyte.

Although in the preferred method described above, an etched valve-metal foil was employed, the method of this invention is more generally applicable to forming a uniform valve-metal oxide film on other material. For example, it is known in the art to provide a fibrous web of cloth or paper to which is applied by spraying a layer of a valve-metal. This valve-metal layer normally and desirably has a rough surface that reflects the undulations and rough pattern of the underlying fibrous material. The valve-metal surface also may be rough as a result of the metal spraying leaving agglomerated particles of metal distributed within the surface of the metal layer. The ratio of this rough surface area to the plane surface area is similar to the etch ratio of the above described etched foil, and as with etched foil, the method of this invention is applicable to compensate for variations along the length of the web in this ratio for forming a uniform oxide film thereon.

It will be recognized that the particular apparatus described for performing the method of this invention is only illustrative of a variety of systems that may be designed, following the principles of this invention, to achieve the same result. In fact, a person may simply observe an ammeter that indicates total forming current, and may draw the foil by hand at a speed that maintains the current at a predetermined desired value.

What is claimed is:

1. A method for continuously forming a uniform oxide film on a valve-metal surface comprising:

a. passing continuously through a liquid electrolyte a material having a valve metal surface;

b. applying a constant d.c. voltage between said material and an electrode in fluid contact with said electrolyte; and c. varying the speed of said passing to maintain constant the forming current produced thereby.

2. The method of claim 1 wherein said valve-metal is selected from aluminum and tantalum.

3. The method of claim 1 additionally comprising cooling said liquid electrolyte to maintain a constant temperature thereof.

4. The method of claim 1 additionally comprising automatically adding fresh electrolyte to maintain a constant concentration of said liquid electrolyte.

5. The method of claim 1 additionally comprising recirculation pumping said liquid electrolyte for the purpose of equalizing and stabilizing the temperature and concentration thereof.

6. The method of claim 1 wherein said material is in the form of a web.

7. The method of claim 6 wherein said web is a fibrous sheet material selected from paper and cloth.

8. The method of claim 2 wherein said valve-metal surface is rough, a layer of valve-metal having been deposited on said fibrous sheet material so as to generally conform to the undulations in the surface of said fibrous sheet.

9. The method of claim 6 wherein said web having a valve-metal surface is an etched valve-metal foil.

10. The method of claim 6 wherein said passing is accomplished by drawing said web from a web supply roll, said forming current is sensed by an electrical sensing means, and said varying is accomplished by automatically varying the speed of said drawing inversely with said electrically sensed current, with reference to a predetermined desired value for said current, for the purpose of maintaining said current constant at said desired value.

11. The method of claim 10 wherein said drawing of said web is accomplished by a variable speed motor being coupled to a web take-up spindle and wherein the power to said motor is adjusted in inverse response to said sensed current by an automatic regulating means.

12. The method of claim 10 wherein said drawing of said web is accomplished by means of a variable speed motor and a coupling means for maintaining a constant ratio between said drawing speed and said motor speed, and wherein said varying is accomplished by an electrical regulator for supplying varying power to said motor in inverse response to said sensed current.

13. The method of claim 6 wherein said valve-metal surface is rough and the ratio of the rough surface area to the plane surface area varies along the length of the web.

* * * * *

Disclaimer 3,962,048.—*Curtiss M. Gilbert, Richard A. Bemis* and *Norman D. Schulze,* North Adams, Mass. METHOD FOR FORMING A UNIFORM OXIDE FILM ON A VALVE METAL. Patent dated June 8, 1976. Disclaimer filed Nov. 14, 1983, by the assignee, *Sprague Electric Co.*

Hereby enters this disclaimer to claims 1, 2, 3, 4, 5, 6, 7, 8 and 9 of said patent.

[*Official Gazette January 10, 1984.*]